US005884338A

United States Patent [19]

Golde

[11] Patent Number: 5,884,338

[45] Date of Patent: Mar. 23, 1999

[54] GARMENT WITH MAP ACCESS POCKET SYSTEM

[75] Inventor: Paul J. Golde, Mission Viejo, Calif.

[73] Assignee: Intersport Fashions West, Tustin, Calif.

[21] Appl. No.: 996,521

[22] Filed: Dec. 23, 1997

[51] Int. Cl.[6] ..... A41D 27/20

[52] U.S. Cl. ..... 2/247; 224/660; 224/236; 206/775; 206/776; 206/778; 2/250; 2/252; 2/253

[58] Field of Search ..... 2/247, 248, 249, 2/250, 251, 252, 79, 227, 69, 69.5, 80, 46, 22, 23, 24; 283/34; 150/111, 112, 113, 166, 167, 900, 152, 131, 133, 134, 135, 142, 144, 148, 145; 224/240, 235, 236, 660, 662, 663, 665, 676, 677, 680, 681, 682, 683, 230, 246, 250, 904; 206/315.1, 214, 775, 778, 783, 776, 479

[56] References Cited

U.S. PATENT DOCUMENTS 3,337,101 8/1967 Tombari ..... 2/247

4,218,781 8/1980 Lieberman ..... 2/247

OTHER PUBLICATIONS

Gershman, Maurice, "Self Adhering Nylon Tapes."The J.A.M.A., vol. 168, No. 7, Oct. 1958, p. 930.

*Primary Examiner*—Jeanette Chapman
*Attorney, Agent, or Firm*—Terry L. Miller

[57] ABSTRACT

A garment for wear by the operator of a sport motor vehicle includes a map access pocket system disposed on or formed as part of an outer surface of the garment. This map access pocket system is configured to present a map to the wearer of the garment in a convenient orientation to be easily read when the map access pocket system is opened. The map access pocket system includes features which improve readability of the map by presenting the map aligned along a line of sight of the wearer of the garment, and other features which discourage the wearer of the garment from attempting to read the map while the vehicle is in motion. The map access pocket system also provides for storage of small items which are easily accessed by the operator of the vehicle. Both the map and other small items stored in the map access pocket system are protected from water, moisture, snow, and other elements commonly encountered in operation of sport motor vehicles.

23 Claims, 2 Drawing Sheets

GARMENT WITH MAP ACCESS POCKET SYSTEM

BACKGROUND OF THE INVENTION

1. Field of the Invention

The present invention is in the field of garments for wear by operators of sport motor vehicles. More particularly, the present invention is in the field of garments to be worn by operators of such vehicles as snow mobiles, ATV's, and motorcycles, for example, which provide for convenient storage of small items in a pocket system on the exterior of the garment, and which is conveniently accessed by the wearer of the garment. Still further, the invention relates to such a storage pocket system which provides for storage of a map, and when the pocket is opened also provides for convenient presentation of the map to the wearer of the garment in an easily read orientation.

2. Related Technology

Lap top desks for use by pilots have been known for a long time. It is common for a pilot (especially the pilot of a small general aviation aircraft) to use such a lap top desk to hold and display maps and charts so that the pilot can use these while also piloting the aircraft. Such lap top desks are not suitable for use by the operators of other types of sport motor vehicles. For example, the operator of a motorcycle or snow mobile could not rely on such a lap top desk because the desk could be dislodged from the rider's lap while the vehicle is in motion. Once such a lap top desk was dislodged from the rider's lap, it would certainly be lost from the moving vehicle.

Similarly, tank bags for use on motorcycles have been known for a long time, some of which include provision for storing and displaying a map in front of the rider of the motorcycle. Generally, such tank bags include a transparent plastic weather-proof map holder envelope which is secured to the upper surface of the tank bag and which is visible to the operator of the vehicle while the vehicle is in motion. Unfortunately, such tank bag map holders may lead to motorcycle accidents because some riders will unadvisedly try to read the map while also operating the motorcycle. Even though some such tank bag map holders include a warning label advising against such a use of the map holder, some motorcycle operators will ignore this warning and will still attempt to read a map while the motorcycle is in motion. Understandably, such uses of the conventional map holders sometimes result in accidents.

Also, such conventional tank bag map holders are not suitable for use on other types of sport motor vehicles because many of these vehicles do not have a tank upon which the bag could be mounted. Additionally, these tank bag map holders have the disadvantage of not being easily detached from the vehicle. Thus, when the operator of a motorcycle equipped with such a tank bag wishes to stop and read the map at a location apart from the motorcycle (at a road-side picnic table, for example) the rider will have to spend some time removing the map from the holder, or removing the map holder and map from the tank bag.

Further, in the operation of some sport motor vehicles, such as all terrain cycles (ATC's), all terrain vehicles (ATV's), and snow mobiles, as well as other vehicles, it is common for the operator of the vehicle to venture "cross country", perhaps following natural geographic features, using a GPS system, or using compass headings and orienting from one point to another across the landscape. In such uses of these vehicles, it is desirable for the operator of the vehicle to have a map close at hand and easily accessible. On the other hand, it is not desirable for the operator to be able to read the map while the vehicle is in motion for the same reasons discussed above concerning motorcycle tank bag map holders. Additionally, when a snowmobile operator is orienting by compass, it is generally best to stop the vehicle and walk some distance from it so that the compass provides the most accurate indication of magnetic north.

SUMMARY OF THE INVENTION

In view of the above, it is desirable and is an object of this invention to provide a map storage system which will stow a map on the person of a motor vehicle operator, and which makes the map easily accessible to the person.

Further, it is desirable and is an object for this invention to provide such a map storage system which discourages the person using it from attempting to read the map while also operating a motor vehicle.

Still further, an object for this invention is to provide such a map storage system which is configured as a pocket attached to a garment worn by the operator of a motor vehicle, and which presents a map stored in the system in an orientation to be easily read by the wearer of the garment.

Yet another object for this invention is to provide such a map storage system which is water resistant to prevent the map from getting wet in rainy or snowy conditions, and which also provides for storage of other small items in a water resistant enclosure.

Additional objects and advantages of the present invention will be apparent from a reading of the following detailed description of a single exemplary preferred embodiment of the invention, taken in conjunction with the appended drawing Figures, in which like reference numerals indicate the same feature throughout the several views, or indicate features which are analogous ins structure or function.

BRIEF DESCRIPTION OF THE DRAWING FIGURES

FIG. 1 provides a perspective view of a person wearing an outer garment incorporating the present invention, and operating a sport motor vehicle (i.e., a snow mobile in this instance);

FIG. 2 is a fragmentary front elevation view of the garment and map storage pocket system;

FIG. 3 provides a fragmentary perspective view generally from the view point of the operator of the vehicle seen in FIG. 1, and showing the map storage pocket system in an opened position; and FIG. 4 is a fragmentary exploded perspective view similar to FIG. 3, but showing a map holder of the map storage pocket system removed from a place of attachment to better illustrate features of the present embodiment of the invention.

DETAILED DESCRIPTION OF A PREFERRED EXEMPLARY EMBODIMENT OF THE INVENTION

Figure 1:
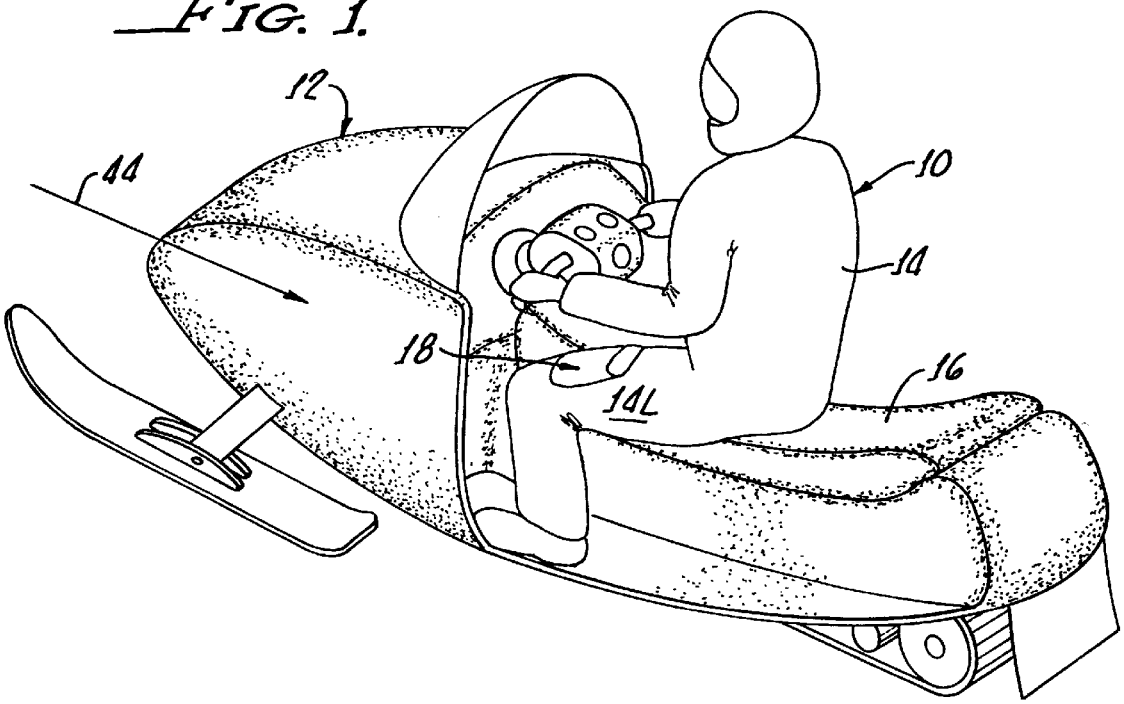

Viewing the appended drawing Figures in conjunction with one another, and particularly first viewing FIG. 1, it is seen that a rider and operator 10 is riding a sport vehicle 12 and is clothed in an outer one-piece cover-all style of garment 14. A garment incorporating or embodying the present invention need not be one piece or of cover-all style, and may be a pant, vest, or jacket, for example, instead of the particular one-piece cover-all style of garment depicted. In this case, the sport vehicle 12 is a snowmobile, although the present invention is also not so limited, and may find application to garments used in other situations and with other types of vehicles. For example, the sport vehicle 12 might be a motor cycle or all-terrain vehicle (ATV), for example. As seen in FIG. 1, the operator 10 is seated astride the vehicle 12, with the rider's legs extending generally forwardly, and in this case the operator 10 is seated astride the longitudinally extending seat 16 of the vehicle 12. The garment 14 provides, disposed on the left leg of this garment (indicated with numeral 14L), a map access pocket system 16, which is described with greater particularity by reference to the drawing FIGS. 2–4.

Figure 2:
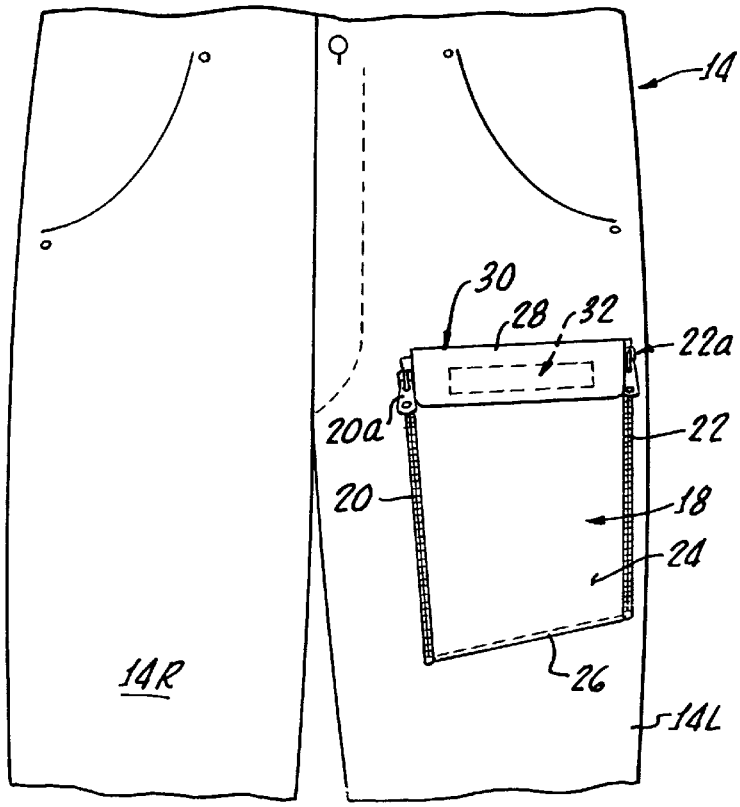
Figure 3:
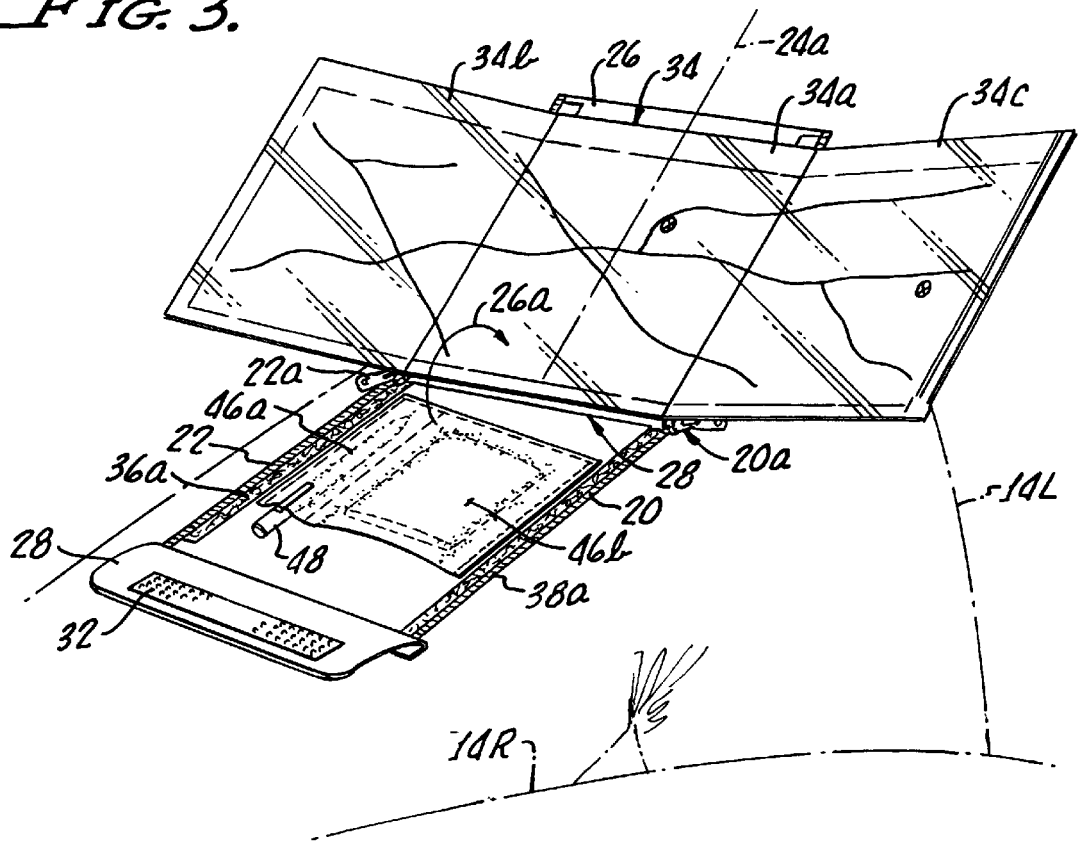
Figure 4:
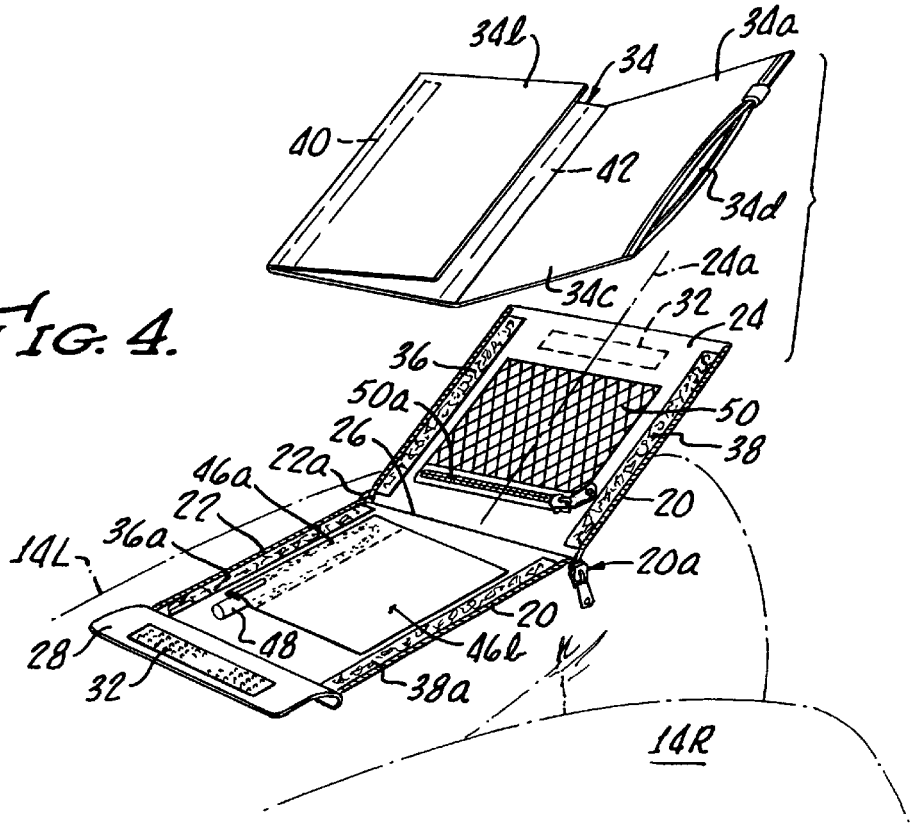

Consider now drawing FIGS. 2–4 in conjunction with one another (and note that in these drawing Figures the garment 14 is shown in positions other than the seated position for its wearer as seen in FIG. 1, for example). The garment 14 is shown in a fragmentary frontal view in FIG. 2, and it is to be noted in FIG. 2 that the map access pocket system 16 includes a "patch style" pocket structure 18 disposed upon the left leg 14L of the garment 14 and generally aligned in its illustrated closed position with the length of this garment leg (and with the operator's thigh within this garment leg). The right leg 14R of the garment 14 is also partially illustrated to better depict the orientation of the pocket system 18. However, the invention is not limited to this or any other particular location or orientation of the pocket system 18 on a garment. For example, the pocket 18 could be disposed upon either leg of the garment, or could be placed upon the breast of a jacket of vest.

Viewing the drawing Figures, it will further be noted that the pocket structure 18 is most preferably not rectangular in the view provided by FIG. 2, but is preferably trapezoidal for a purpose to be better explained below. In other words, a bottom seam of the pocket structure (which is further described below) is oriented at an angle to the perpendicular of the length of the leg of the garment and wearer of this garment.

The pocket structure 18 in this case is characterized by having a pair of generally vertically extending spaced apart zippers 20 and 22, each attached to the underlying fabric of the leg 14L, and also to each side of and securing a "patch" 24 of the pocket structure 18 to the leg 14L. These zippers 20, 22 run vertically from adjacent a bottom seam 26 at which the patch 24 is stitched to the fabric of leg 14L. At their upper ends, the zippers 20, 22 end under a flap 28. The flap 28 is itself secured to the fabric of the leg 14L at a generally horizontally extending seam 30. As is seen in FIG. 2, the zipper pulls 20*a* and 22*a* are pulled up under the flap 28, and this flap 28 is secured in place by an area 32 of mating hook-and-loop fastener (i.e., Velcro, for example), one part of which is secured to the outer surface of the patch 24, and the other part of which is secured to the underside of flap 28. The zipper pulls 20*a* and 20*b* are preferably provided with zipper pulls, such as the lanyards depicted in the drawing Figures in order to allow their operation even by gloved hands, as is further explained below. In this closed configuration of the pocket 18 (viewing FIG. 2), it is to be appreciated that any contents of the pocket which have been placed there by the operator 10, for example, are secure within the closed pocket structure.

Viewing FIGS. 3 and 4 now, FIG. 3 provides a perspective view of the pocket structure 18 generally from the vantage point of the seated operator 10 with the pocket opened. That is, the operator has separated the hook-and-loop fastener 32 on flap 28, and has pulled down the pulls 20*a* and 22*a* of zippers 20 and 22, to free the upper extent of the patch 24 from the underlying garment leg 14L (the patch 24 remains secured to the garment leg 14L at bottom seam 26). Accordingly, the patch 24 is seen to "hinge" downwardly (i.e., away from the face of operator 10 as is indicated by the arcuate arrow 26*a* in FIG. 3) about the seam 26 because of the flexibility of the fabric from which the pocket system 18 is made. Also, it is to be noted in FIG. 3 that because of the trapezoidal shape of the pocket structure 18 and the resulting angling of the seam 26 relative to a perpendicular to the length of the operator's thigh (recalling FIG. 2), as the patch 24 hinges or flexes to the position seen in FIG. 3 generally about seam 26, the patch portion 24 moves from alignment with the pocket structure 18 as seen in FIG. 2, and comes into general alignment at a center line 24*a* with the line of view of the operator 10. That is, the fully opened position for patch 24 becomes one of general alignment at center line 24*a* in plan view with a radial line extending outwardly from the face of the seated rider (recalling FIG. 1).

Removably attached to the patch 24 is a tri-fold transparent envelope form of protective map holder 34. The patch 24 has two strips or elongate sections 36, 38 of one part of a hook-and-loop fastener, one extending along each side of the inside surface of patch 24. Likewise, the tri-fold map holder 34 has two sections (i.e., strips) 40, 42 of the mating part of the hook and loop fastener secured to a center portion 34*a* (i.e., the center portion of three flexibly inter-attached integral portions 34*a*, 34*b*, and 34*c* of the transparent tri-fold map envelope). Thus, the map holder 34 at portion 34*a* is brought into general alignment with the operator's point of view. The three sections 34*a, b*, and *c* of map holder 34 are sized such that a standard highway or USGS (i.e., United States Geological Survey) map, for example, may be folded to display a particular part of the map, and will fit within this transparent map holder envelope. Thus, when the tri-fold map holder envelope 34 is opened as seen in FIG. 3, a particular section of the map is presented to the operator 10 with the map aligned for easiest viewing by the operator. In order to complete the protection offered by the map holder 34, preferably this map holder pocket 34 has an integral water-proof zipper type of closure 34*d* running along one side. This water-proof zipper closure 34*d* for the envelope of map holder 34 allows a map secured within the envelope to be protected from the elements, and still to be easily visible to the operator 10.

It is to be noted that the operator 10 can remove the map holder 34 from the patch 24 for ease of viewing and use of the map therein, or may attach the map holder 34 to the inner portion (i.e., to the "leg" portion) of the pocket system. That is, the map holder 34 may be attached alternatively to two strips 36*a*, 38*a* of hook-and-loop fastener provided within the pocket 18 on the "leg-side" of this pocket. In the event that the map holder 34 is attached to the "leg-side" of the pocket 18, the operator 10 will not enjoy the advantage of having the map moved into an aligned position for easy viewing when the pocket is opened. However, the map within holder 34 may be viewed in this position (probably requiring the user to tilt their head somewhat for alignment with the map), and can easily be detached from within the map pocket system 18 while still within the map holder 34 for ease of viewing and use.

Importantly, regardless of which one of the two alternative positions the map holder 34 occupies in pocket system 18, the direction of opening of patch 24 results in this patch opening in opposition to any prevailing air flow (indicated by arrow 44 on FIG. 1) so that the operator 10 will be discouraged from attempting to open the pocket 18 and from trying to read a map in map holder 34 while the vehicle 12 is in motion. In other words, the construction of the map pocket system 18 causes the air stream 44 from the moving vehicle to close the pocket and discourage map reading while moving on the vehicle 12. Thus, the safety of operation of vehicle 12 is improved because the operator 10 will be encouraged to stop the vehicle before attempting to read a map in holder 34.

As is seen in FIGS. 3 and 4, the map pocket system 18 also includes a number of internal convenience features, such as a pair of pockets 46*a*, 46*b*, which are sized to accept on the one hand, a pen 48, and one the other hand to possibly accept a wallet or credit card holder. Similarly, on the inner surface of patch 24, the pocket system 18 provides a mesh pocket 50 provided with a zipper 50*a*, allowing the operator 10 to store loose items or change, for example, in this inner pocket. The partial transparency provided by the mesh face of this pocket 50 allows the operator 10 to see what is in this pocket without the necessity of opening it.

In use of the pocket system 18, the operator 10 will fold and insert a map into the holder 34, and attach this holder within the map pocket system 18 in one of its two alternative positions as described above. Other small items, such as a pen, wallet, change, etcetera, which the operator 10 may choose to take along while operating the vehicle 12 may also be stowed in the pocket system 18. Closing the map pocket system 18 to is position seen in FIGS. 1 and 2 protects all of the items stowed within. On the other hand, opening the pocket system to its position as depicted in FIGS. 3 and 4, is easily accomplished even with gloved hands (recalling the zipper pull lanyards on zipper pulls 20*a* and 22*a*). Once opened, the map holder 34 will be presented to the operator 10 in an alignment providing for easy viewing of the map within this holder if the holder 34 is secured to the inner surface of the patch 24. If the holder 34 is secured by the operator to the "leg-side" of the map pocket system 28, then the map is presented in an alignment along the thigh of the user, which will generally be somewhat angled with respect to the operator's line of sight in plan. However, the map can still be read in this alignment. Also, the map holder 34 (and the map is encloses) may easily be removed from within the map holder pocket system 18 for reading of the map. Also, as noted above, the orientation of the patch 24 and its "hinging" at a lower edge of the patch 24 results in the patch tending to catch any air flow which results from movement of the vehicle 12 and to close. As a result, the user 10 is discouraged from attempting to both operate the vehicle 10 and read the map at the same time.

While the present invention has been depicted and described by reference to one particularly preferred exemplary embodiment of the invention, such reference does not imply a limitation on the invention, and no such limitation is to be inferred. The invention is capable of considerable modification and alteration, and such is intended to fall within the scope of the appended Claims. For example, it is apparent that the map access pocket system of the present invention could be configured as a separate structure removably attached to an outer garment, for example, by the user of a hook-and-loop fastener. Accordingly, the present invention is intended to be limited only by the spirit and scope of the appended Claims, giving cognizance to equivalents in all respects.

I claim:

1. A map access pocket system for an outer garment, said map access pocket system comprising:

a pocket structure attachable to said outer garment, said pocket structure having a pocket patch portion movable between an opened position and a closed positions;

a transparent map holder;

in said closed position said pocket patch portion covering said transparent map holder, and in said opened position of said pocket structure said map holder being uncovered by said pocket patch portion and being disposed to be viewed by a wearer of the garment.

2. The map access pocket system of claim 1 in which said pocket patch portion on an inner side thereof carries said transparent map holder.

3. The map access pocket system of claim 2 wherein said pocket patch portion is flexibly attached to said garment along a line which is angled relative to a perpendicular to a line of sight of the wearer of said garment, said pocket patch portion hinging at said line and in said opened position of said pocket patch portion said transparent map holder being oriented in alignment with line of sight of the wearer of the garment.

4. The map access pocket system of claim 2 wherein said pocket patch portion is attached in said closed position to an underlying part of the garment by means of a pair of spaced apart generally vertically extending linear fasteners.

5. The map access pocket system of claim 4 in which said pair of spaced apart generally vertically extending linear fasteners includes a pair of zippers.

6. The map access pocket system of claim 4 wherein said pocket patch portion is further attached in said closed position to an underlying part of the garment by means of a flap overlying at least a portion of said pocket patch portion.

7. The map access pocket system of claim 3 in which said pocket system is disposed upon a leg of said garment, and in said closed position said pocket structure is generally trapezoidal and has a lower edge at which said pocket patch portion is flexibly attached, in said closed position said pocket system having a centerline which is generally aligned with a thigh of the wearer of the garment.

8. The map access pocket system of claim 3 in which said transparent map holder includes a transparent tri-fold envelope for receiving a map therein.

9. The map access pocket system of claim 8 in which said transparent map holder includes a weather-proof zip closure when open allowing a map to be inserted, and when closed excluding water and other environmental elements.

10. The map access pocket system of claim 2 in which said transparent map holder and said pocket patch portion each include respective strips of a hook-and-loop fastener.

11. The map access pocket system of claim 10 in which said transparent map holder is configured as a tri-fold envelope having a center section for attachment within said pocket structure, said center section of said tri-fold transparent map holder having a pair of spaced apart strips of hook-and-loop fastener disposed thereon.

12. The map access pocket system of claim 10 in which said pocket structure includes on said pocket patch portion a pair of spaced apart strips of hook-and-loop fastener mating with strips of fastener on said transparent map holder.

13. The map access pocket system of claim 10 in which both said pocket patch portion and a confronting leg-side portion of said pocket structure include respective pairs of spaced apart strips of hook-and-loop fastener each mating with strips of fastener on said transparent map holder, whereby said transparent map holder may be removably attached to an inner surface of the pocket patch portion or to an outer surface of the leg-side portion of the pocket structure, in each case to be covered by the pocket patch portion in the closed position of the pocket structure.

14. The map access pocket system of claim 1 further including an inner pocket covered by said pocket patch portion when the pocket structure is closed.

15. A method of providing to the wearer of a garment a map which is easily readable by the wearer of the garment while aboard an open-air sport motor vehicle and of also of discouraging the wearer of the garment from reading the map while the vehicle is in motion, said method comprising steps of:

providing a map pocket system on a surface of the garment in the view of the wearer of the garment while positioned to operate the vehicle;

providing a map holder within the map pocket system; and providing the map pocket system with a portion moving to an open position in opposition to prevailing air flow caused by movement of the vehicle to allow viewing of the map only when said portion is in said open position, whereby if the operator opens said portion of said map pocket system with the vehicle in motion then prevailing air flow will engage said portion and tend to close this portion so as to obscure the map from the view of the wearer of the garment.

16. The method of claim 15 further including the step of providing the map pocket system on an outer surface of a garment to be worn by the vehicle operator.

17. The method of claim 16, including the step of disposing the map pocket system upon a leg of the garment.

18. The method of claim 17 including the step of configuring the map pocket system to be generally of trapezoidal shape when closed, and to include a pocket patch portion hinging at a lower edge and when open generally aligning with a line of sight of the wearer of the garment in a seated position.

19. An outer garment having a map access pocket system, said map access pocket system comprising:

a pocket structure attached to said outer garment, said pocket structure having a pocket patch portion hinging between an opened and a closed positions, said pocket patch portion when closed covering a transparent map holder disposed removably within said map access pocket system, and in said opened position of said map access pocket system said pocket patch portion revealing said map holder which is disposed to be viewed by a wearer of the garment;

said map holder including a transparent tri-fold envelope for receiving a map therein; said envelope having a weather-proof zip closure, and also carrying a pair of spaced apart strips of hook-and-loop fastener for removably securing the map holder within said pocket structure; and said pocket structure inwardly including a matching pair of strips of hook-and-loop fastener for receiving said map holder removably within the pocket structure.

20. The outer garment of claim 19 in which said pocket patch portion defines an inner surface carrying said matching strips of hook-and-loop fastener for attaching said map holder.

21. The outer garment of claim 19 wherein said pocket patch portion is flexibly attached to said garment along a line which is angled relative to a perpendicular to a line of sight of the wearer of said garment in plan view with the wearer in a seated position, whereby in the opened position of said pocket patch portion said map holder is oriented in alignment with the line of sight of the wearer of the garment.

22. The outer garment of claim 21 in which said map access pocket system is disposed upon a leg of said garment, and in said closed position said pocket structure is generally trapezoidal and has a lower edge at which said pocket patch portion is flexibly attached to the garment, in said closed position said pocket system having a vertically extending centerline which is generally aligned with the length of a thigh of the wearer of the garment.

23. In a garment for wear by an operator of an open-air motor vehicle, a method of both providing a map which is protected from the elements and visible to the operator, and of also discouraging the operator from attempting to operate the vehicle in motion and to read the map at the same time, said method comprising steps of:

disposing the map in a transparent weather-proof envelope through which the map may be read by the operator of the vehicle;

providing a pocket structure on the garment and having an opaque cover flap movable between a first position over the weather-proof envelope and map therein and obstructing the operator's view of the map, and a second position allowing the map to be seen my the operator; and so positioning the pocket and the cover flap of this pocket that relative air flow caused by movement of the vehicle in operation is utilized to move the cover flap into the first position;

whereby, the operator is required to stop the vehicle, terminating the prevailing air flow caused by such movement of the vehicle and to move the flap to the second position revealing the map and map holder before the map may be read by the operator, and if the operator attempts to move the cover flap of the pocket to its second position and read the map while the vehicle is moving, then prevailing air flow caused such movement of the vehicle will continuously tend to move the cover flap to its first position obstructing the operator's view of the map.

* * * * *